United States Patent [19]

Nickelston

[11] Patent Number: 5,044,806

[45] Date of Patent: Sep. 3, 1991

[54] BACK SCRUBBER

[76] Inventor: Bob J. Nickelston, Rt. 6, P.O. Box 232, Martinsville, Va. 24112

[21] Appl. No.: 585,822

[22] Filed: Sep. 20, 1990

[51] Int. Cl.[5] ..... A45D 40/00

[52] U.S. Cl. ..... 401/88; 401/6

[58] Field of Search ..... 401/88, 6

[56] References Cited

U.S. PATENT DOCUMENTS

| | | | |
|---|---|---|---|
| 1,290,238 | 1/1919 | Klenetzky | 401/88 |
| 1,329,097 | 1/1920 | Rubin et al. | 401/88 |
| 1,675,022 | 6/1928 | Creegan | 401/88 |
| 1,689,787 | 10/1928 | Kupferschmid | 401/88 |

FOREIGN PATENT DOCUMENTS

| | | | |
|---|---|---|---|
| 827994 | 2/1938 | France | 401/88 |

*Primary Examiner*—Steven A. Bratlie

[57] ABSTRACT

A back scrubber is provided which contains a bar of soap for application by bathers and others who need a convenient way to clean hard to reach areas along their backs. The back scrubber will securely engage a conventional soap bar and when the bar has been substantially consumed, a releasable jaw allows for easy substitution of a fresh bar. The back scrubber is light in weight and can be integrally formed by molding from a lightweight, durable plastic.

4 Claims, 2 Drawing Sheets

BACK SCRUBBER

BACKGROUND OF THE INVENTION

1. Field Of The Invention

The invention herein pertains to a device for assisting in washing one's back and other body regions and specifically refers to such a device which contains a bar of soap.

2. Description Of The Prior Art And Objectives Of The Invention

Various back scrubbers have been employed throughout the years in the form of brushes with long handles. Such devices must be dipped into soapy water prior to their use and oftentimes can abrade and irritate the skin, particularly on elderly or infirm bathers. The need for applying soap while bathing to hard to reach back regions, particularly for older bathers such as those in hospitals and rest homes, has increased with the population of the elderly rapidly growing in recent years. Also, elderly patients in rest homes oftentimes prefer to bathe themselves, without the assistance of nurses or orderlies and so the need has multiplied for a device which will assist them in conveniently bathing hard to reach areas.

Therefore, with the shortcomings and disadvantages of prior art back scrubbing devices, the present invention was conceived and one of its objectives is to provide a back scrubber which will allow the user to apply a bar of soap directly on the skin to any area of one's body during bathing.

It is yet another objective of the present invention to provide a back scrubber which includes a soap container into which a bar of soap can be easily inserted and securely held or removed after use.

It is still another objective of the present invention to provide a back scrubber which allows the user to consume a maximum amount of the soap bar before exchanging it for a fresh bar.

It is yet another objective of the present invention to provide a back scrubber which is relatively light in weight, durable and which is safe and convenient to use.

Various other objectives and advantages of the present invention become apparent to those skilled in the art as a more detailed presentation follows below.

SUMMARY OF THE INVENTION

The aforesaid and other objectives are realized by providing a lightweight, plastic back scrubber having a planar base with a handle extending therefrom. A pair of soap bar retaining jaws are positioned on the top surface of the base with one of the jaws being spring-loaded. A grip to slide the spring-loaded jaw is located on the underneath side of the base and is joined to the spring-loaded jaw. Thus, a container for a soap bar is formed by the base and the pair of jaws mounted thereon. The spring-loaded jaw is laterally slidable along the base whereby a cake of soap can be placed between the jaws and the soap is held in position for use by the bather. Each of the jaws have a plurality of small cylindrically shaped pins for securely engaging the soap bar preventing it from slipping from the jaws during use.

DESCRIPTION OF THE PREFERRED EMBODIMENT

The preferred form of the invention is shown in FIGS. 1–4 whereby a back scrubber is formed from a plastic such as polyethylene or other suitable, lightweight, durable synthetic materials. A container for a bar of soap is formed by the planar base and a pair of jaws, one of which is slidable laterally along the base. A coil spring is positioned within a base groove between the jaws to apply pressure on the slidable jaw, allowing a bar of soap to be tightly clinched between the plurality of pins on the opposing jaws. The slidable jaw can be opened or released from the soap bar by urging the opening member beneath the base, outwardly by the use of finger pressure. The soap bar is held along its lower most portion or edge, thereby allowing maximum use of the soap bar. An elongated handle is affixed to the base and extends twelve to eighteen (12–18) inches therefrom, providing the user ease and convenience in reaching the lower back or other body regions during bathing. A leather or nylon thong may be inserted through an opening at the distal end of the handle so the device can be hung from a faucet or bracket during periods of nonuse.

DETAILED DESCRIPTION OF THE DRAWINGS AND OPERATION OF THE INVENTION

Figure 1:
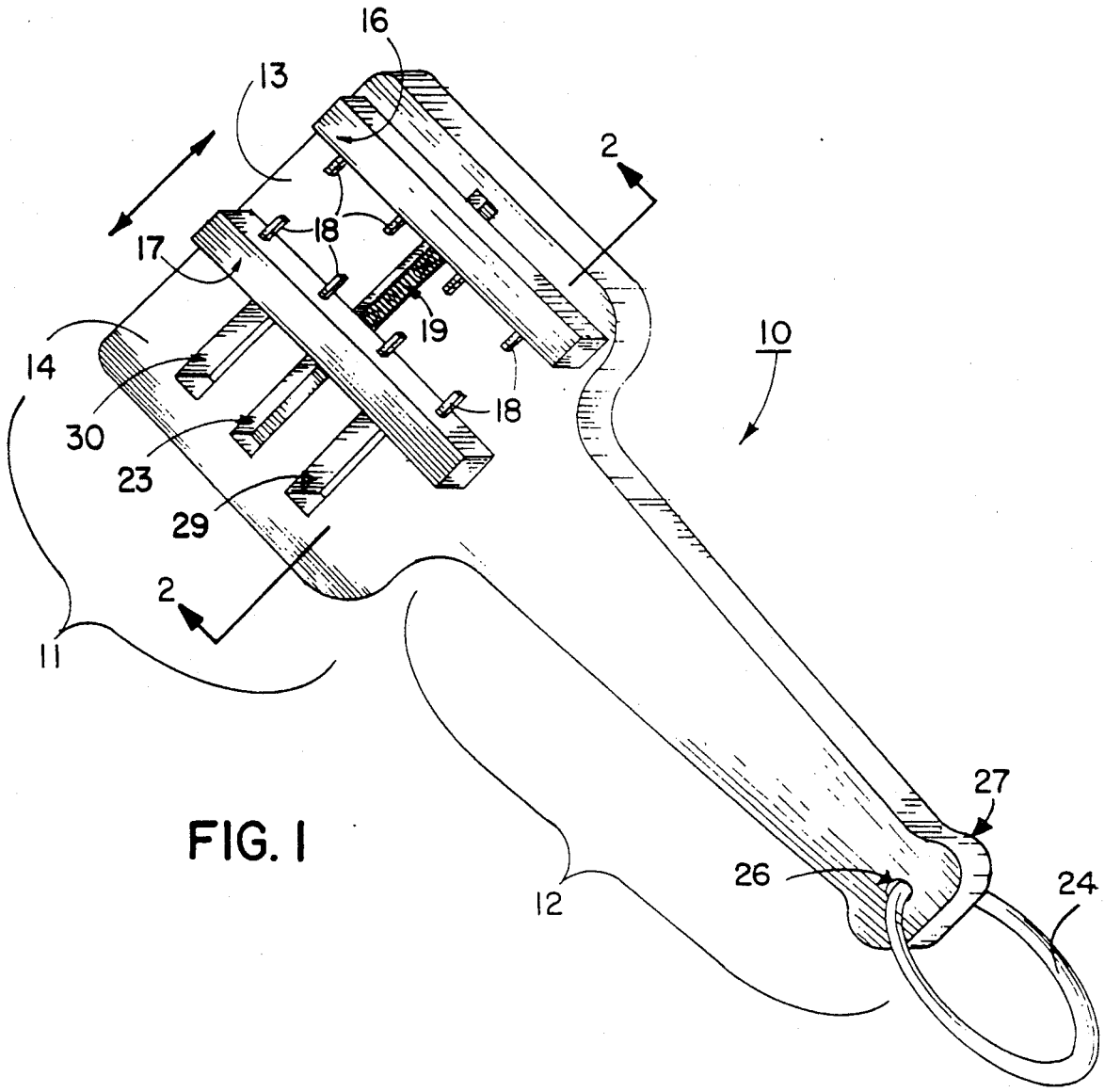
FIG. 1 illustrates in a top perspective view the back scrubber of the invention without a bar of soap positioned thereon.
Figure 4:
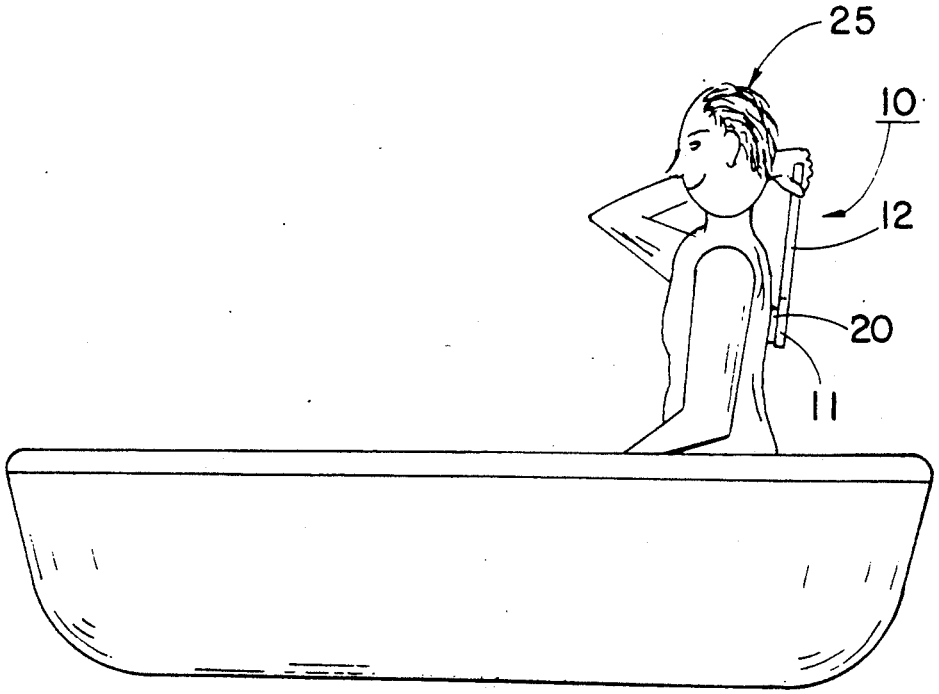
FIG. 4 shows the device as being used by a bather.

For a more complete understanding of the invention and its operation, turning now to the drawings, FIG. 1 illustrates back scrubber 10 having an upper enlarged segment or base 11 and an elongated lower segment or handle 12 extending therefrom. As seen in FIG. 4, user 25 grasps the elongated handle 12 and is therefore able to conveniently reach any area of the lower or upper back region. As hereinbefore mentioned, back scrubber 10 is extremely useful and convenient for elderly infirm patients or others who prefer to remain independent and to bathe alone, without the assistance of nurses, orderlies or the like.

Base 11 and handle 12 may be integrally molded from any of a variety of lightweight, thin planar plastic materials such as polyethylene, polyvinyl chloride compositions, and other synthetic or natural materials such as wood. A variety of sizes can be manufactured, and base 11 has been sized to accommodate a conventional soap bar approximately two by four (2×4) inches in width and length respectively and approximately one (1) inch in thickness. Handle 12 extends approximately twelve to sixteen (12–16) inches from base 11 although other lengths and sizes ma be helpful under particular circumstances. Base 11 and handle 12 may each be one-quarter (¼) of an inch thick or may be other thicknesses as needed, depending on the particular material used.

Figure 2:
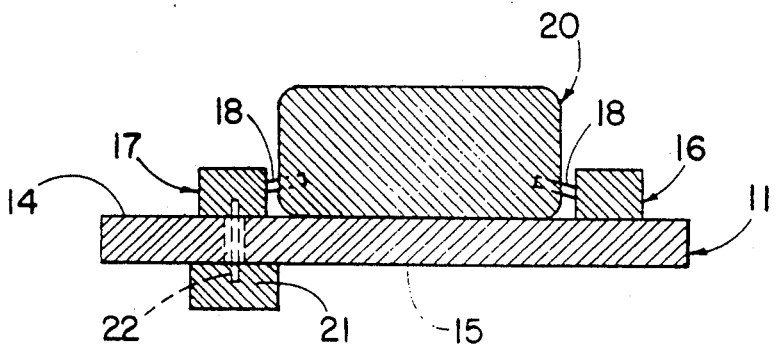
FIG. 2 illustrates the soap bar in place on a cross-sectional view of the back scrubber as shown along lines 2—2 of FIG. 1.
Figure 3:
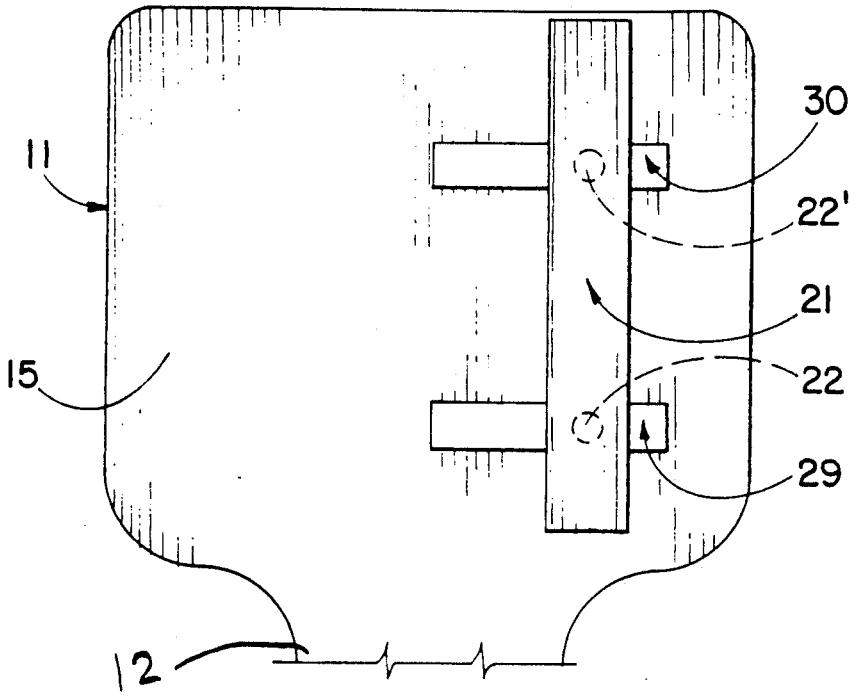
FIG. 3 depicts the bottom surface of the base of the invention.

As also shown in FIG. 1, positioned on base 11 are jaws 16 and 17 which include a plurality of cylindrical pins 18. Jaw 16 as shown in FIG. 1 is immovably fixed directly to base 11 whereas jaw 17 is slidable therealong in a transverse or lateral direction. As further shown, jaw 17 is opposingly positioned to jaw 16 whereby bar soap 20 can be releasably engaged therebetween as shown in FIG. 2. Bar soap 20, as seen in FIG. 2, receives pins 18 therealong to hold soap 20 in place against upper surface 14 of base 11. As also shown in FIG. 2, pins 18 engage bar soap 20 along the bottom portion, below the midpoint, near the bottom of bar soap 20 whereby the user can utilize the maximum amount of bar soap 20 before replacing the same. As would be understood, bar soap 20 can be removed by opening said jaws by laterally urging jaw 17 from right to left as shown in FIG. 2, outwardly by grasping the means 21 beneath base 11, i.e., opening means 21 positioned against bottom surface 15 of base 11 as shown in FIG. 3. As further illustrated, opening means 21 is joined to jaw 17 by a pair of mounting studs 22, 22' as shown in broken line fashion in FIG. 3. Stud 22 is positioned in base slot 29 whereas stud 22' is positioned in base slot 30. When opening means 21 is moved outwardly, resilient coil spring 19 (shown in FIG. 1) stretches under tension and when opening means 21 is released, jaw 17 will thereby slide inwardly, towards jaw 16 to engage bar soap 20 therebetween. Resilient coil spring 19 is formed from plated steel, stainless steel, nylon or other materials which would not deteriorate in the wet environment in which back scrubber 10 is used. Spring 19 resides in base groove 23, which allows jaw 17 to move along surface 14 of base 11, as spring 19 is beneath surface 14.

Thus, a soap bar can easily be inserted in soap container 13 on planar top surface 14 of base 11 between jaws 16 and 17 by applying finger pressure to opening means 21 in a transverse direction, outwardly, causing jaws 16 and 17 to disengage or open.

Handle 12 is grasped as shown in FIG. 4 and back scrubber 10 is thus used to apply bar soap 20 to the desired back areas of the user. Also, thong 24 which may be formed of leather, nylon or other suitable materials passes through handle opening 26 at distal end 27 thereof to allow back scrubber 10 to be hung during periods of nonuse. While in the embodiment shown only one jaw is movably affixed to base 11, both jaws could be made movable as desired.

The illustrations and examples provided herein are for explanatory purposes and are not intended to limit the scope of the appended claims.

I claim:

1. A back scrubber for holding a bar of soap comprising: a soap bar container, said container comprising a planar base having top and bottom surfaces, a pair of opposingly positioned soap bar engaging jaws, said jaws mounted on said top surface of said planar base, one of said pair of jaws being slidably affixed to said base for releasable engagement with said soap bar, a means to manually open said slidable jaw, said opening means positioned on said bottom surface of said base, said base defining a lateral slot, means to attach said slidable jaw to said opening means, said attaching means extending through said slot for movement therealong, said attaching means fixed to said slidable jaw and to said opening means, a resilient member, said resilient member positioned laterally along the center of said base and affixed to said slidable jaw, each of said pair of jaws comprising a plurality of soap bar engaging pins, a handle, said handle joined to said base and extending therefrom.

2. The back scrubber as claimed in claim 1 wherein the top surface of said base defines a laterally placed center groove, said groove for containing said resilient member whereby said soap bar is positioned over said resilient member and is held in place by said pins.

3. The back scrubber as claimed in claim 1 wherein said base defines a pair of attaching means slots, said slots for receiving said attaching means.

4. The back scrubber as claimed in claim 1, said scrubber formed from a plastic material.

* * * * *